US010347962B1

(12) United States Patent
Georgakopoulos

(10) Patent No.: US 10,347,962 B1
(45) Date of Patent: Jul. 9, 2019

(54) FOLDABLE, DEPLOYABLE AND RECONFIGURABLE ORIGAMI ANTENNAS USING FABRIC, TEXTILE OR OTHER MATERIAL ENCAPSULATION AND/OR SCAFFOLDING

(71) Applicant: Stavros Georgakopoulos, Miami, FL (US)

(72) Inventor: Stavros Georgakopoulos, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/000,178

(22) Filed: Jun. 5, 2018

(51) Int. Cl.
*H01Q 1/36* (2006.01)
*H01Q 1/08* (2006.01)
*H01Q 1/38* (2006.01)

(52) U.S. Cl.
CPC ..... *H01Q 1/085* (2013.01); *H01Q 1/362* (2013.01); *H01Q 1/38* (2013.01)

(58) Field of Classification Search
None
See application file for complete search history.

(56) References Cited

U.S. PATENT DOCUMENTS

| | | | | |
|---|---|---|---|---|
| 9,214,722 | B2 * | 12/2015 | Georgakopoulos | H01Q 1/36 |
| 9,847,570 | B2 * | 12/2017 | Georgakopoulos | H01Q 1/08 |
| 10,020,586 | B1 * | 7/2018 | Georgakopoulos | H01Q 1/38 |
| 2006/0214855 | A1 * | 9/2006 | Harada | H01Q 1/38 343/700 MS |
| 2012/0086615 | A1 * | 4/2012 | Norair | H01Q 1/44 343/720 |
| 2014/0340275 | A1 * | 11/2014 | Georgakopoulos | H01Q 1/36 343/834 |
| 2017/0025748 | A1 * | 1/2017 | Georgakopoulos | H01Q 1/08 |
| 2018/0278200 | A1 * | 9/2018 | Jeon | H02S 30/20 |

* cited by examiner

*Primary Examiner* — Trinh V Dinh
(74) *Attorney, Agent, or Firm* — Saliwanchik, Lloyd & Eisenschenk

(57) ABSTRACT

A foldable antenna can comprise a bottom encapsulation layer, a plurality of origami substrates disposed on the bottom encapsulation layer, a top encapsulation layer disposed on the plurality of origami substrate, and a conductive trace disposed on the top encapsulation layer. The plurality of origami substrates can be spaced apart from each other. The bottom encapsulation layer and the top encapsulation layer can comprise a fabric, and each of the plurality of origami substrates can comprise at least one of foam, plastic, carton, FR4, laminate, and wood.

20 Claims, 16 Drawing Sheets

100

FOLDABLE, DEPLOYABLE AND RECONFIGURABLE ORIGAMI ANTENNAS USING FABRIC, TEXTILE OR OTHER MATERIAL ENCAPSULATION AND/OR SCAFFOLDING

STATEMENT OF GOVERNMENT SUPPORT

This invention was made with government support under Grant No. EFRI 1332348 awarded by the National Science Foundation. The government has certain rights in the invention.

BACKGROUND

Axial mode conventional helical antennas (HAs) have been widely used in satellite communications and global positioning systems due to their high gain and circular polarization. The properties of conventional helical antennas have been extensively studied. Segmented helical antennas (SHAs), such as square cross section helical antennas, have been investigated. SHAs can provide approximately equivalent performance compared to the conventional helical antenna. The linear segments, which make up an SHA, can be easily supported on a dielectric structure. This kind of structure can be designed and manufactured at a very low cost. Even though these HAs and SHAs have many merits, they need a large height, so it is not easy to move them.

BRIEF SUMMARY

Embodiments of the subject invention provide novel and advantageous foldable antennas that comprise two encapsulation layers, and a plurality of origami substrates encapsulated by the two encapsulation layer, thereby allowing the foldable antenna to be deployable and reducing the volume of the foldable antenna while remaining a helical antenna.

In an embodiment, a foldable antenna can comprise: a bottom encapsulation layer; a plurality of origami substrates disposed on the bottom encapsulation layer; a top encapsulation layer disposed on the plurality of origami substrate; and a conductive trace disposed on the top encapsulation layer. The plurality of origami substrates can be spaced apart from each other.

In another embodiment, a method of manufacturing a foldable antenna can comprise: preparing a bottom encapsulation layer; disposing a plurality of origami substrates on the bottom encapsulation layer; preparing a top encapsulation layer; disposing a conductive trace on the top encapsulation layer; and attaching the top encapsulation layer to the bottom encapsulation layer such that the plurality of origami substrates are encapsulated by the bottom encapsulation layer and the top encapsulation layer. The plurality of origami substrates can be spaced apart from each other.

In yet another embodiment, a foldable antenna can comprise: a bottom encapsulation layer; a plurality of origami substrates disposed on the bottom encapsulation layer; a top encapsulation layer disposed on the plurality of origami substrate and the bottom encapsulation layer; and a conductive trace disposed on the top encapsulation layer, wherein the plurality of origami substrates are spaced apart from each other and each of the plurality of origami substrate is encapsulated by the bottom and top encapsulation layers. The top encapsulation layer can comprise a plurality of folding patterns corresponding to the plurality of origami substrates, where at least one of the bottom encapsulation layer and the top encapsulation layer comprises a fabric, where each of the plurality of origami substrates comprises at least one of foam, plastic, carton, FR4, Duroid®, and wood, and where the conductive trace comprises at least one of conductive cloth tape, conductive thread, conductive tape, conductive wire, and microfluidic channel with liquid metal.

BRIEF DESCRIPTION OF DRAWINGS

FIG. 2(*b*) shows a plurality of origami substrates on a bottom encapsulation layer of a foldable antenna according to an embodiment of the subject invention.

FIG. 2(*c*) shows a top encapsulation layer of a foldable antenna according to an embodiment of the subject invention.

FIG. 2(*d*) shows a conductive trace on a top encapsulation layer of a foldable antenna according to an embodiment of the subject invention.

FIG. 2(*e*) shows sewing the foldable antenna according to an embodiment of the subject invention.

FIG. 2(*f*) shows a foldable antenna according to an embodiment of the subject invention.

FIG. 3(*b*) shows a folded state of a foldable antenna according to an embodiment of the subject invention.

FIG. 3(*c*) shows a folded state of a foldable antenna according to an embodiment of the subject invention.

FIG. 5(*b*) shows a folded state of a foldable antenna according to an embodiment of the subject invention.

FIG. 7(*b*) shows a plurality of origami substrates arranged in a swirl shape a foldable antenna according to an embodiment of the subject invention.

FIG. 7(*c*) shows a plurality of origami substrates arranged in a two dimensional array shape a foldable antenna according to an embodiment of the subject invention.

FIG. 8(*b*) shows a measured axial ratio of a foldable antenna according to an embodiment of the subject invention.

FIG. 8(*c*) shows a measured left-hand circular polarization (LHCP) gain of a foldable antenna according to an embodiment of the subject invention.

FIG. 9(*b*) shows a folded state of a foldable antenna according to an embodiment of the subject invention.

FIG. 10(*b*) shows an application of a foldable antenna according to an embodiment of the subject invention to an individual apparatus.

FIG. 10(*c*) shows an application of a foldable antenna according to an embodiment of the subject invention to a satellite.

DETAILED DESCRIPTION

Embodiments of the subject invention provide novel and advantageous foldable antennas that comprise two encapsulation layers, and a plurality of origami substrates encapsulated by the two encapsulation layer, thereby allowing the foldable antenna to be deployable and reducing the volume of the foldable antenna while remaining a helical antenna.

The antennas of embodiments of the subject invention can fold and unfold to correspondingly collapse and deploy. The antennas can also reconfigure their performance. Reconfigurable antennas, arrays, and frequency selective surfaces (FSS) according to embodiments of the subject invention can be developed using fabric, textiles, or other materials to encapsulate thick origami substrates.

These materials (including fabric and textiles) of the antennas can also be integrated with actuation mechanisms, scaffolding, RF connectors, and origami folding mechanisms. The conductive antenna elements can include but are not limited to conductive cloth tape, conductive thread, conductive tape, conductive wire, conductive sheet, and conductive pipes. The conductive antenna elements can also be made using insulated wire, coaxial cable, and/or speedometer wire.

Figure 1:
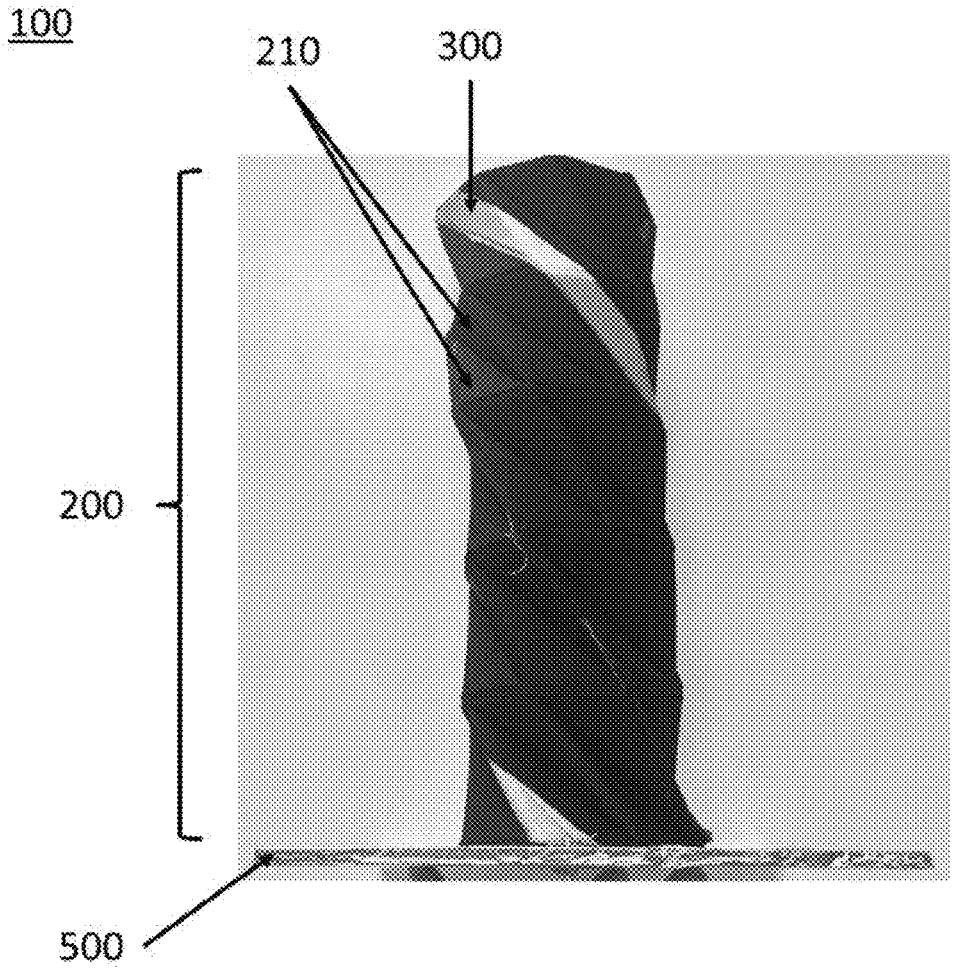
FIG. 1 shows a foldable antenna according to an embodiment of the subject invention.
Figure 2A:
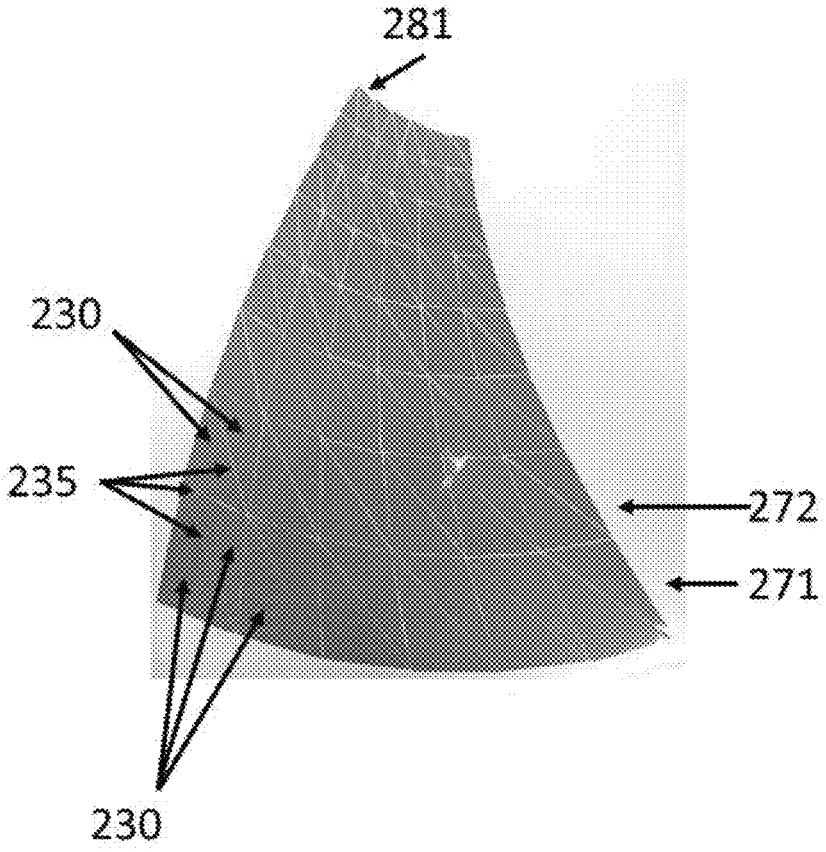
FIG. 2(*a*) shows a plurality of origami substrates of a foldable antenna according to an embodiment of the subject invention.
Figure 2B:
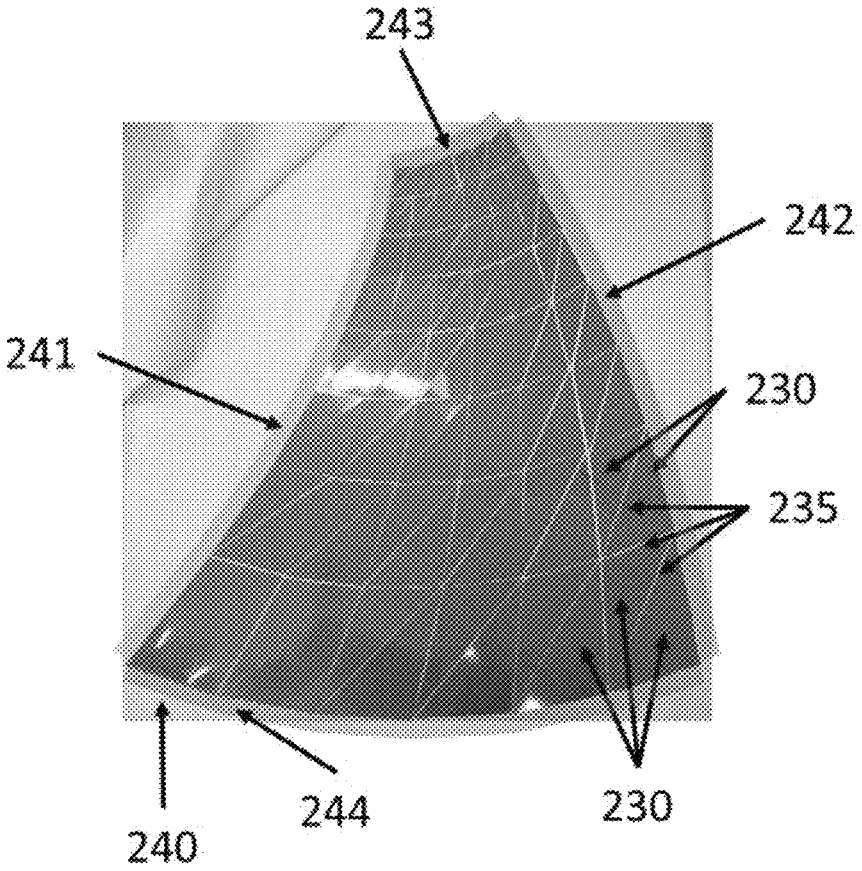
Figure 2C:
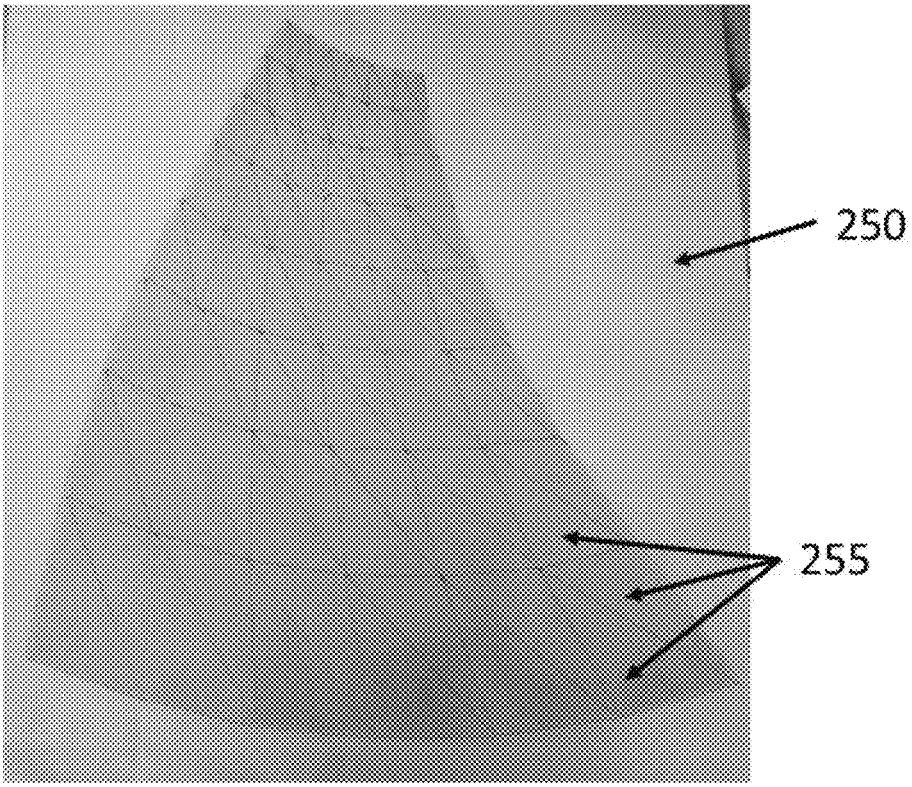
Figure 2D:
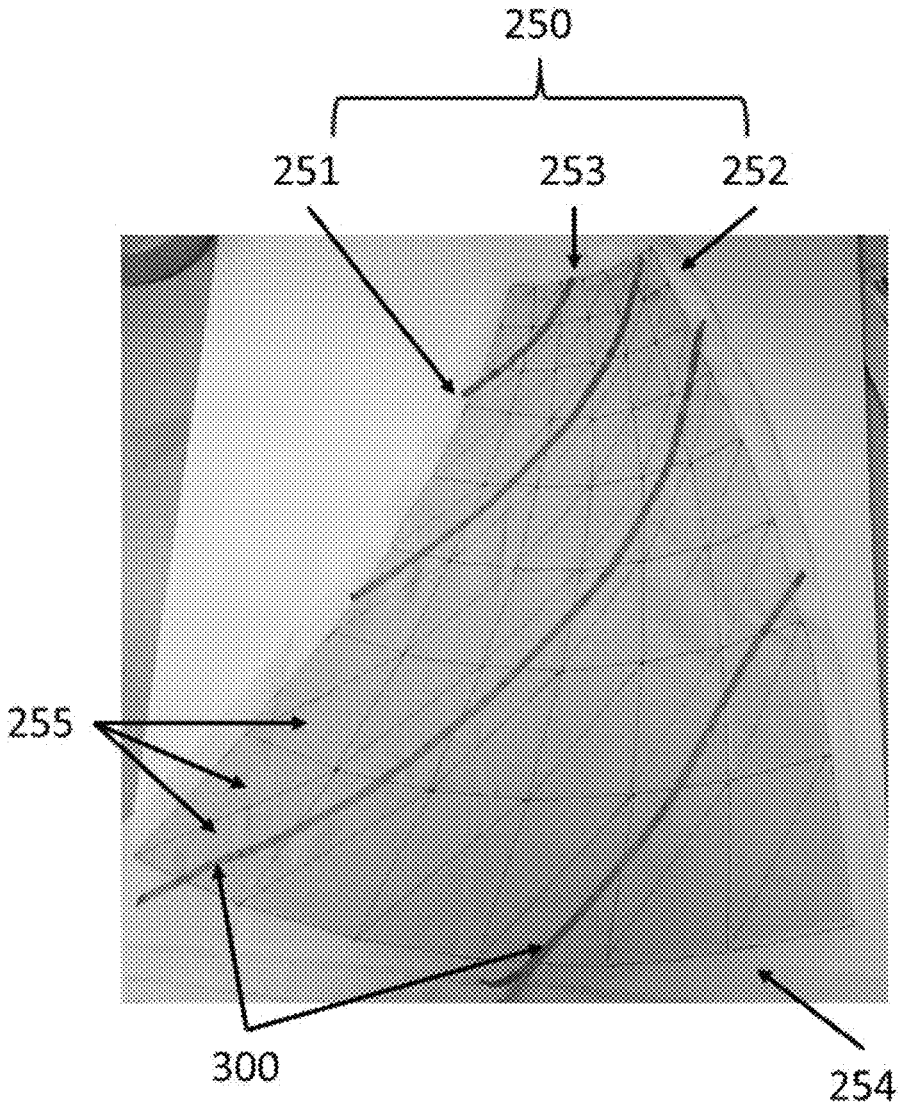
Figure 2E:
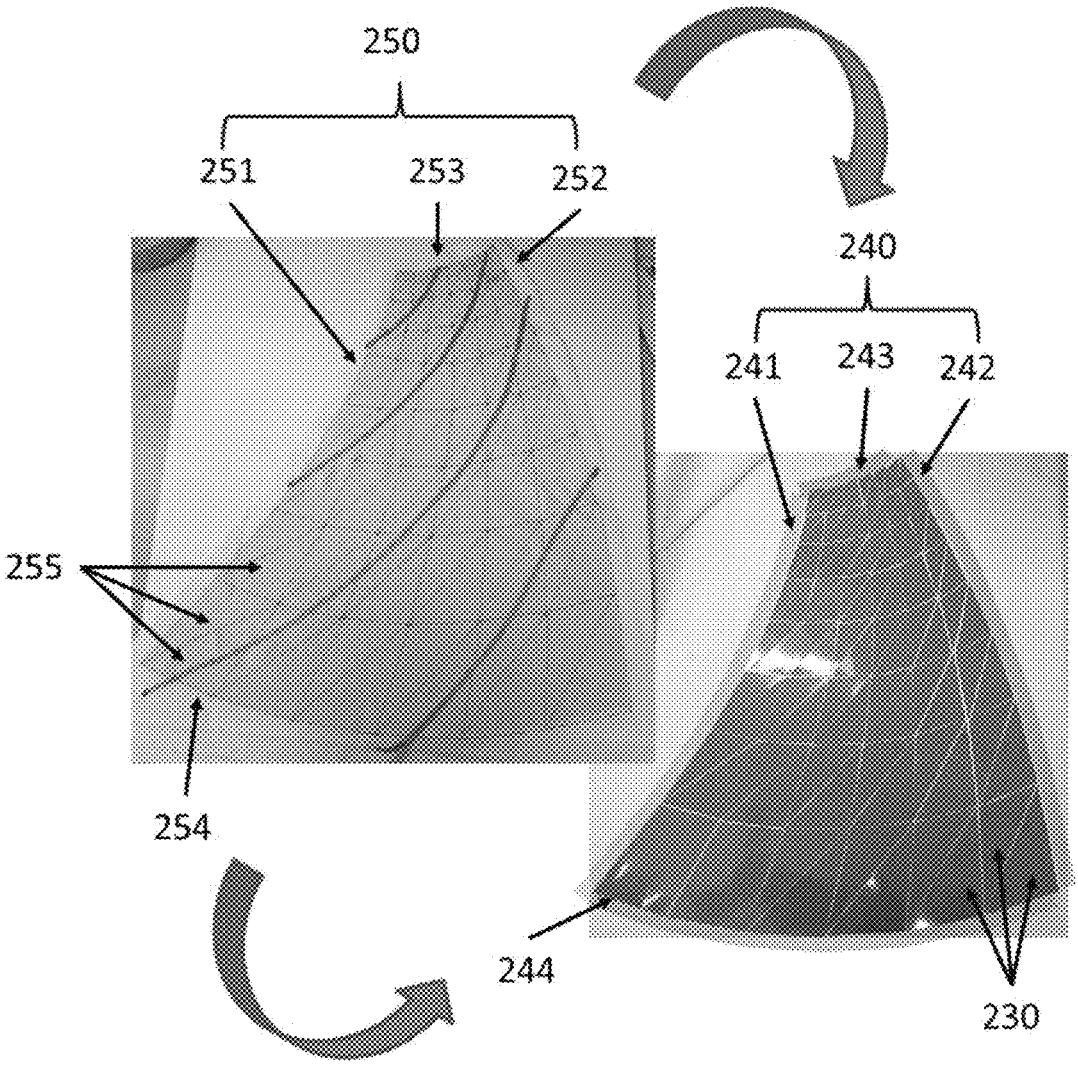
Figure 2F:
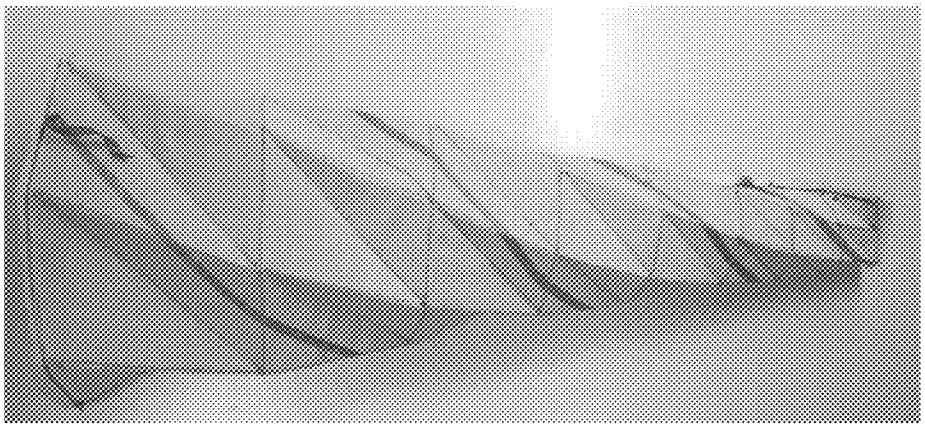

FIG. 1 shows a foldable antenna according to an embodiment of the subject invention. Referring to FIG. 1, a foldable antenna 100 can comprise a conductive ground plane 500 and an antenna structure 200 standing on the conductive ground plane 500. The antenna structure 200 comprises a plurality of fabric origami bases 210 and a conductive trace 300. Each of the plurality of fabric origami bases 210 can comprise two encapsulation layers and an origami substrate encapsulated by the two encapsulation layers.

Two or more layers of encapsulation material (such as fabric, textile, and/or other materials) are used to encapsulate origami substrates. The two layers can be the same material or different materials. The origami substrates (made from thick materials such as foam, plastic, carton, FR4 (glass-reinforced epoxy laminate material), Duroid® (laminate), wood, and/or similar materials) are sandwiched (i.e., encapsulated) between two layers of encapsulation materials. The two layers are held together through glue, sewing/stitching, adhesive, epoxy, and/or similar materials or methods.

The 2-D structure can be folded to provide the 2D or 3D origami antenna, array, or FSS structure. The folded structure may need to be held in place by attaching parts of it at the correct locations, which can depend on the design. The attachment can be achieved using glue, sewing/stitching, adhesive, epoxy, and/or similar materials or methods.

The conductive trace 300 comprises conductive antenna elements, which can include one or more of conductive cloth tape, conductive thread, conductive tape, conductive wire, and microfluidic channel with liquid metal, and the conductive antenna elements are attached to the plurality of fabric origami bases 210 using a fixing material, which can include one or more of glue, sewing/stitching, adhesive, epoxy, and soldering.

FIGS. 2(*a*)-2(*f*) show manufacturing steps of a foldable antenna of an embodiment of the subject invention. Referring to FIGS. 1 and 2(*a*), the foldable antenna 100 can comprise a plurality of origami substrates 230. The plurality of origami substrates 230 can be arranged to form an array. For example, each of the plurality of origami substrates 230 can have a triangular shape, twelve origami substrates are arranged in a first row 271, another twelve origami substrates are arranged in a second row 272, and two origami substrates are arranged to form a first column 281. In addition, the origami substrates 230 in the second row 272 can be smaller than the origami substrate 230 in the first row 271, though this can also be reversed. The plurality of origami substrates 230 can be spaced apart from each other and provide a space 235 between the plurality of origami substrates 230 such that the foldable antenna 100 can be folded. The plurality of origami substrates 230 can be formed on a substrate by engraving, molding, or stamping, and can be made of at least one of foam, plastic, carton, FR4, Duroid®, and wood.

FIG. 2(*b*) shows a plurality of origami substrates on a bottom encapsulation layer of a foldable antenna. Referring to FIG. 2(*b*), the plurality of origami substrates 230 can be disposed on a bottom encapsulation layer 240. The bottom encapsulation layer 240 can comprise a plurality of layers and can comprise a fabric or a textile. For example, the bottom encapsulation layer 240 of FIG. 2(*b*) is a white fabric.

The plurality of origami substrates 230 can be arranged on the bottom encapsulation layer 240 to form an array including rows and columns, such that the bottom encapsulation layer 240 comprises a first side peripheral area 241, a second side peripheral area 242, a top peripheral area 243, and a bottom peripheral area 244 around the outermost plurality of origami substrates 230.

FIG. 2(*c*) shows a top encapsulation layer of a foldable antenna. Referring to FIG. 2(*c*), a top encapsulation layer 250 can comprise a plurality of folding patterns 255. The plurality of folding patterns 255 correspond to the plurality of origami substrates 230 and can help the foldable antenna 100 be folded. The plurality of folding patterns 255 are formed by adhering, drawing, or stamping the plurality of folding patterns 255 on the top encapsulation layer 250. The plurality of folding patterns 255 are optional, and thus can be omitted in the manufacturing step. Similar to the bottom encapsulation layer 240, the top encapsulation layer 250 comprises a plurality of layers and can comprise a fabric or a textile. For example, the top encapsulation layer 250 of FIG. 2(*c*) is a white fabric.

FIG. 2(*d*) shows a conductive trace on a top encapsulation layer of a foldable antenna. Referring to FIG. 2(*d*), a conductive trace 300 ca be disposed on the top encapsulation layer 250. The top encapsulation layer 250 can comprise a first side peripheral area 251, a second side peripheral area 252, a top peripheral area 253, and a bottom peripheral area 254 around the outermost plurality of folding patterns 255, and the conductive trace 300 can be disposed on the plurality of folding patterns 255 in a direction from the bottom peripheral area 254 to the second side peripheral area 252 or from the first side peripheral area 251 to the top peripheral area 253.

FIG. 2(*e*) shows a step of sewing the foldable antenna. Referring to FIG. 2(*e*), the top encapsulation layer 250 can be disposed on the plurality of origami substrates 230 and the bottom encapsulation layer 240 such that the plurality of origami substrates 230 are encapsulated by the top encapsulation layer 250 and the bottom encapsulation layer 240. The top encapsulation layer 250 can be attached to the bottom encapsulation layer 240 such that the plurality of folding patterns 255 correspond to the plurality of origami substrates 230, and the first side peripheral area 251, the second side peripheral area 252, the top peripheral area 253, and the bottom peripheral area 254 of the top encapsulation layer 250 correspond to the first side peripheral area 241, the second side peripheral area 242, the top peripheral area 243, and the bottom peripheral area 244 of the bottom encapsulation layer 240, respectively. As a result, the plurality of origami substrates 230 can be sandwiched or encapsulated between the bottom encapsulation layer 240 and the top encapsulation layer 250. In addition, sewing between the top encapsulation layer 250 and the bottom encapsulation layer 240 is performed along the plurality of folding patterns 255.

When sewing the top encapsulation layer 250 and the bottom encapsulation layer 240, a cover layer (not shown) can be attached to the top encapsulation layer 250 or the bottom encapsulation layer 240 for protection, insulation, and/or camouflage. In addition, the cover layer can have an additional folding pattern similar to the plurality of folding patterns 255 of the top encapsulation layer 250.

FIG. 2(*f*) shows a foldable antenna. Referring to FIGS. 2(*e*) and 2(*f*), the final structure of the foldable antenna 100 can be formed by attaching the side peripheral areas of the bottom encapsulation layer 240 and the top encapsulation layer 250. For example, the first side peripheral area 241 of the bottom encapsulation layer 240 can be attached to the second side peripheral area 242 of the bottom encapsulation layer 240, the first side peripheral area 251 of the top encapsulation layer 250 can be attached to the second side peripheral area 252 of the top encapsulation layer 250, the first side peripheral area 241 of the bottom encapsulation layer 240 can be attached to the second side peripheral area 252 of the top encapsulation layer 250, and/or the first side peripheral area 251 of the top encapsulation layer 250 can be attached to the second side peripheral area 242 of the bottom encapsulation layer 240, thereby forming a cone shape foldable antenna (FIG. 2(*f*)) or a cylinder shape foldable antenna (FIG. 1).

Figure 3A:
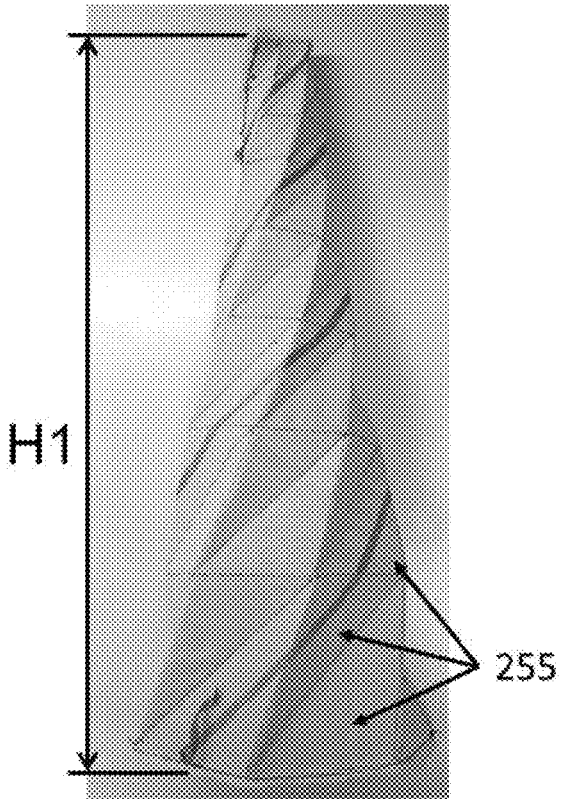
FIG. 3(*a*) shows an unfolded state of a foldable antenna according to an embodiment of the subject invention.
Figure 3B:
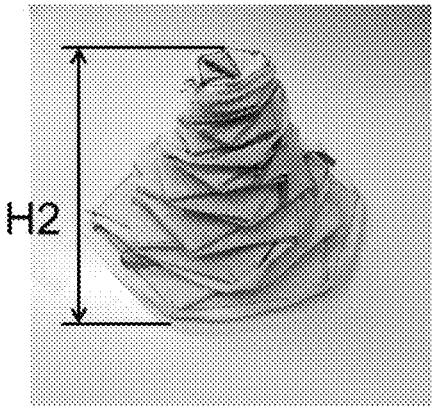
Figure 3C:
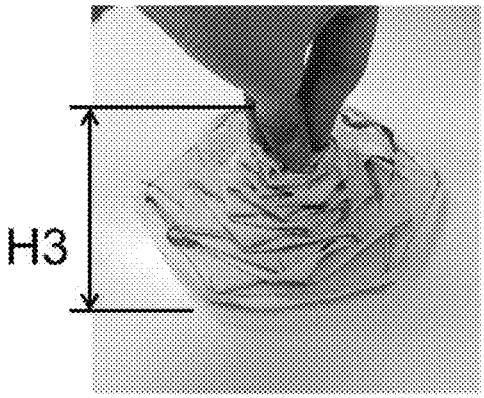

FIGS. 3(*a*)-3(*c*) show an unfolded state and two folded states, respectively, of a foldable antenna according to an embodiment of the subject invention. Referring to FIGS. 3(*a*)-3(*c*), while this particular example of the foldable antenna has a first height H1 of 368 mm in an unfolded state, the foldable antenna has a second height 112 of 100 mm or a third height 113 of 28 mm in a folded state by folding the origami substrates and the folding patterns 255. These heights are provided for exemplary purposes only to show the different heights achievable by folding and should not be construed as limiting.

Figure 4:
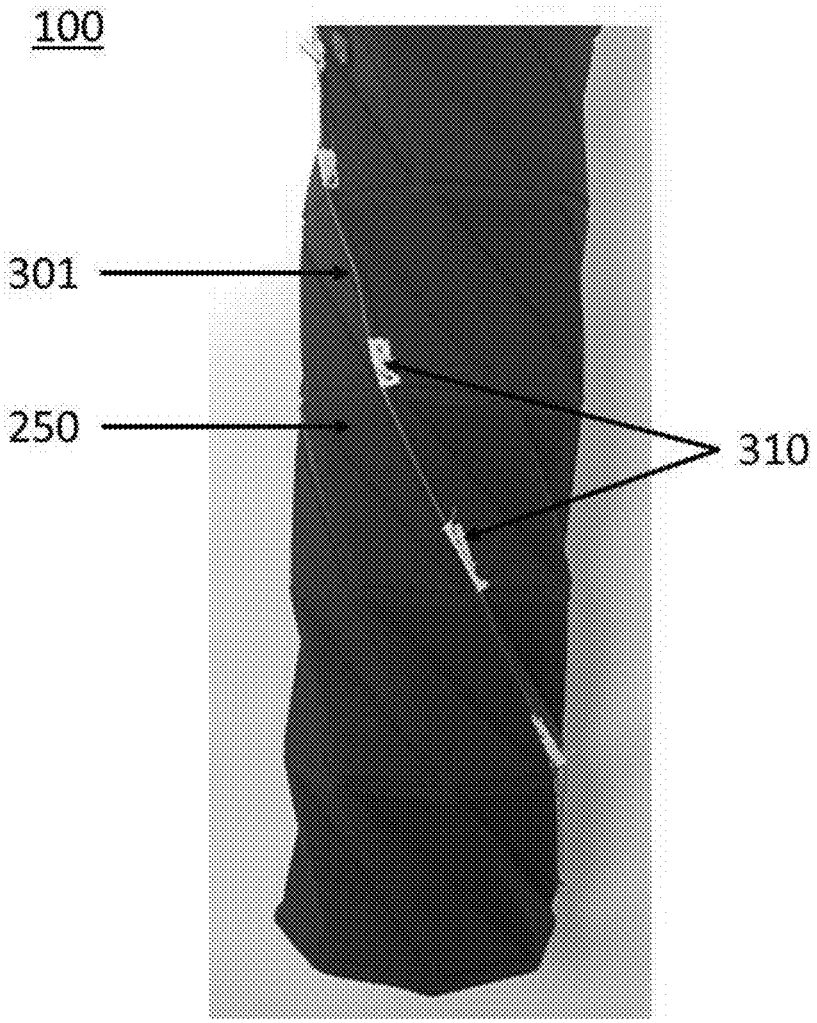
FIG. 4 shows a foldable antenna according to an embodiment of the subject invention.

FIG. 4 shows a foldable antenna according to an embodiment of the subject invention. Referring to FIG. 4, the conductive trace of the foldable antenna 100 is formed by a copper wire 301 on the top encapsulation layer 250 made of a fabric. In addition, the copper wire 301 is attached to the top encapsulation layer 250 by sewing a fabric cannel 310 to the top encapsulation layer 250.

Figure 5A:
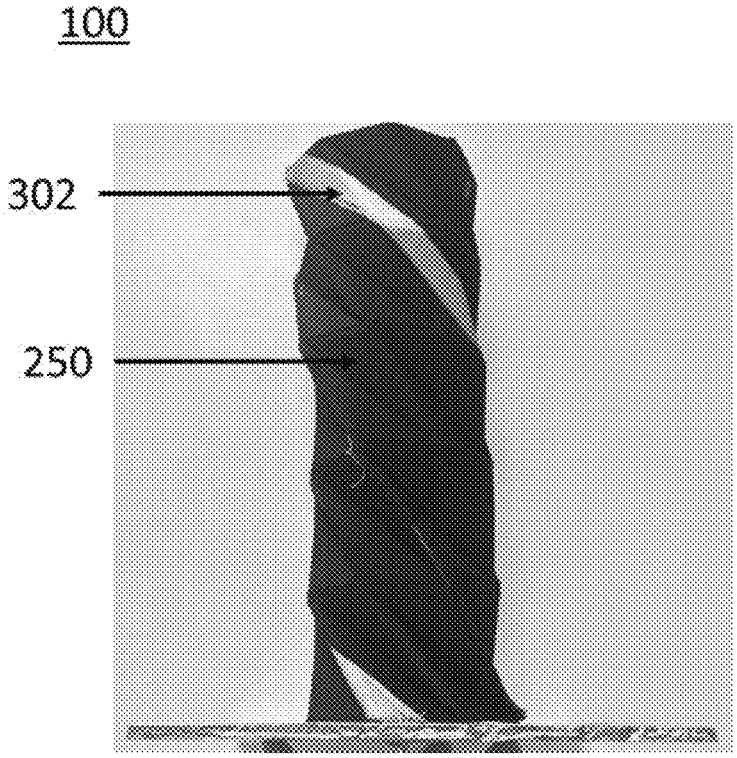
FIG. 5(*a*) shows an unfolded state of a foldable antenna according to an embodiment of the subject invention.
Figure 5B:
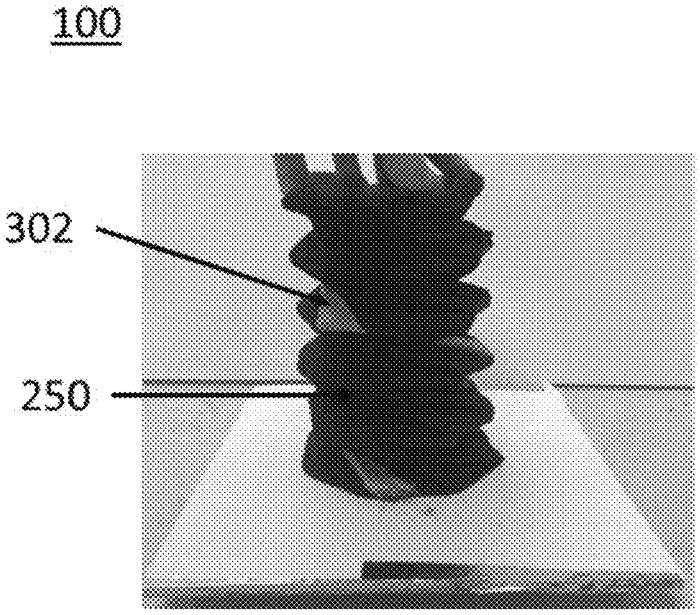

FIGS. 5(*a*) and 5(*b*) show an unfolded state and a folded state of a foldable antenna according to an embodiment of the subject invention. Referring to FIGS. 5(*a*) and 5(*b*), the conductive trace of the foldable antenna 100 is formed by a conductive cloth fabric 302 that is an adhesive antenna trace, and the conductive cloth fabric 302 is formed on the top encapsulation layer 250 made of the fabric. The foldable antenna 100 using the conductive cloth fabric 302 can have an N of 0.95 in the unfolded state and an N of 1.82 in the folded state, wherein N is the number of turns of the helix.

Figure 6:
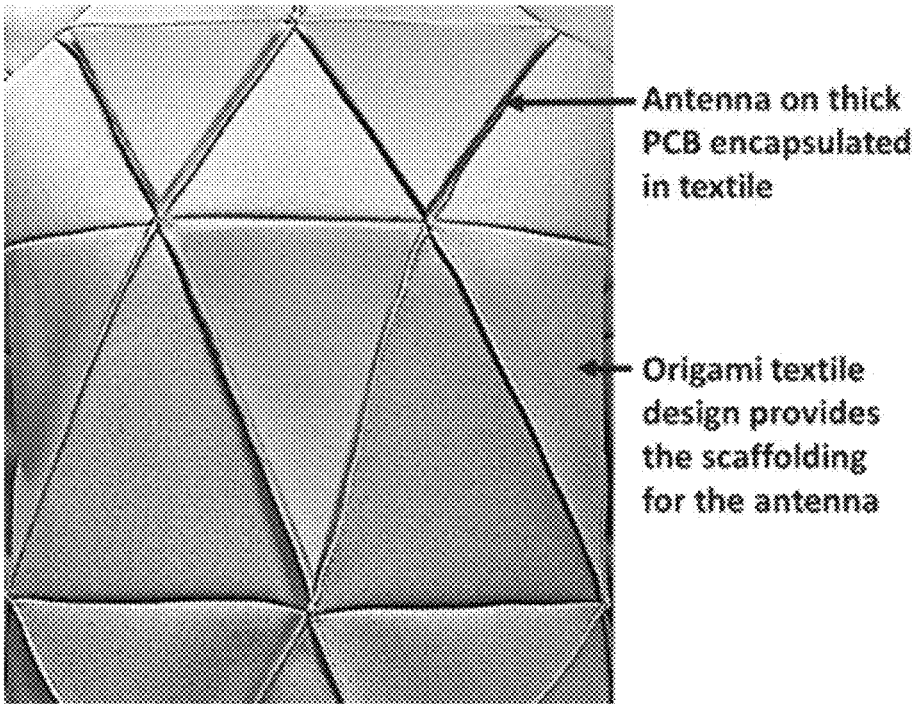
FIG. 6 shows a foldable antenna according to an embodiment of the subject invention.

FIG. 6 shows a foldable antenna according to an embodiment of the subject invention. Referring to FIG. 6, the origami substrate can be formed by a printed circuit board (PCB) and encapsulated by an origami textile design. The three lighter triangles are the traces that are printed on the PCBs, such as FR4, and the grayish triangles are the scaffolding. Each of these traces or antenna elements does not have to cover the entire area of each PCB.

Figure 7A:
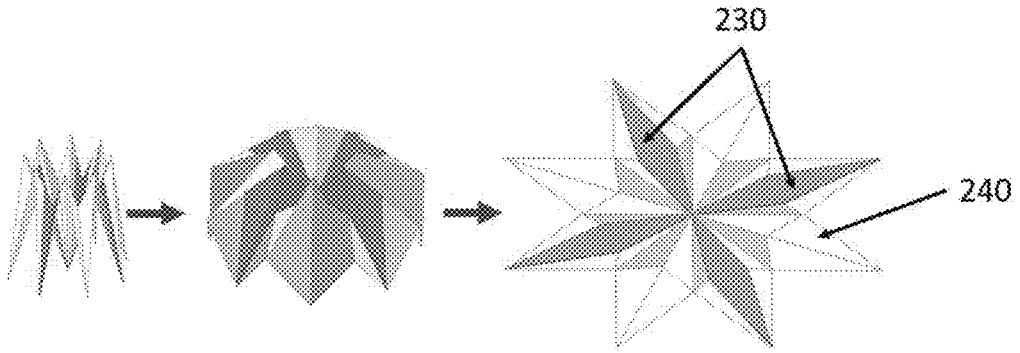
FIG. 7(*a*) shows a plurality of origami substrates arranged in a radial shape in a foldable antenna according to an embodiment of the subject invention.
Figure 7B:
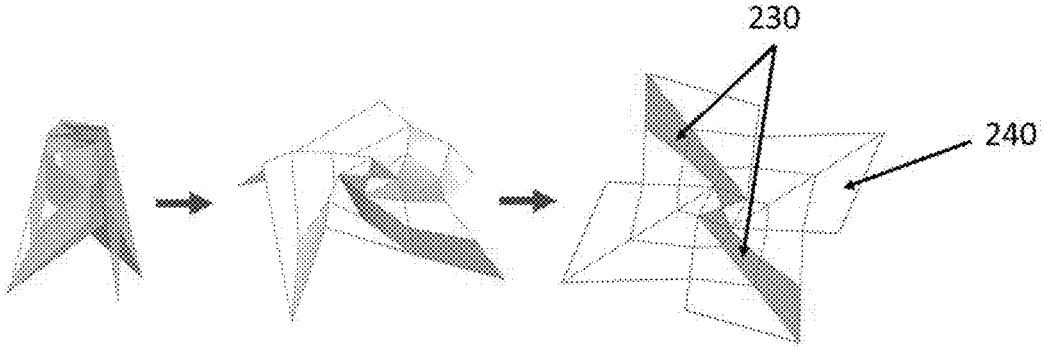
Figure 7C:
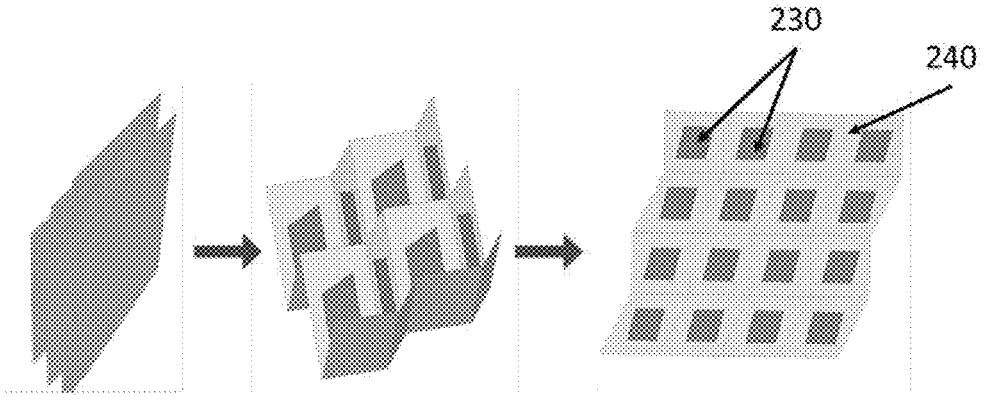

FIGS. 7(*a*)-7(*c*) show a plurality of origami substrates arranged in a foldable antenna according to an embodiment of the subject invention. Referring to FIGS. 7(*a*)-7(*c*), the plurality of origami substrates 230 can be arranged in a radial shape, a swirl shape, or a two dimensional array on the bottom encapsulation layer 240. These non-limiting examples of FIGS. 7(*a*)-7(*c*) are provided for exemplary purposes.

A greater understanding of the present invention and of its many advantages may be had from the following example, given by way of illustration. The following example is illustrative of some of the methods, applications, embodiments, and variants of the present invention. It is, of course, not to be considered as limiting the invention. Numerous changes and modifications can be made with respect to the invention.

Example 1

Figure 8A:
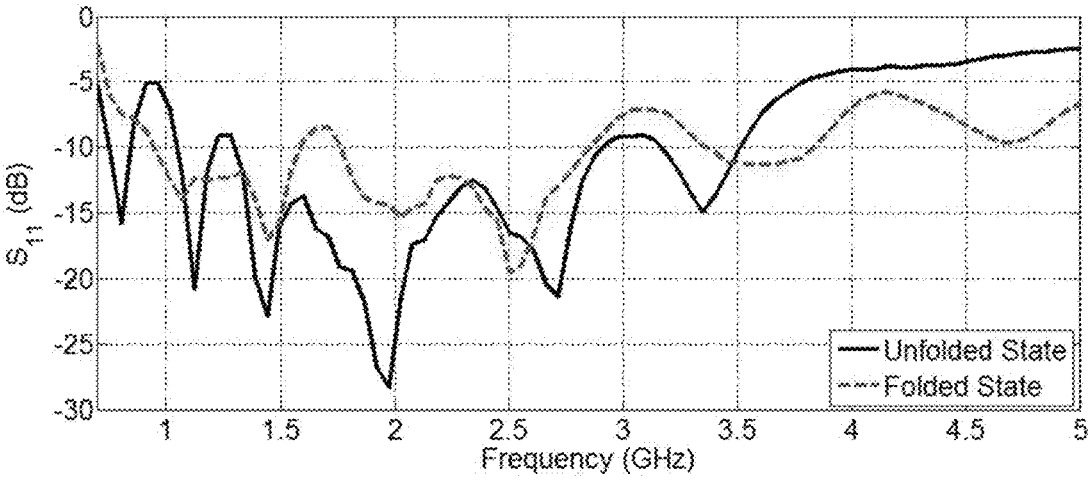
FIG. 8(*a*) shows a measured return loss of a foldable antenna according to an embodiment of the subject invention.
Figure 8B:
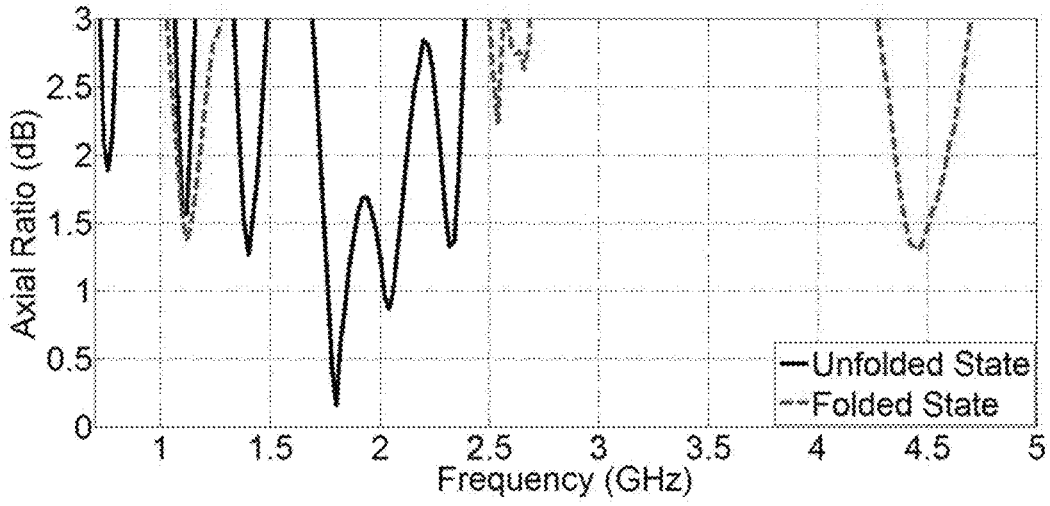
Figure 8C:
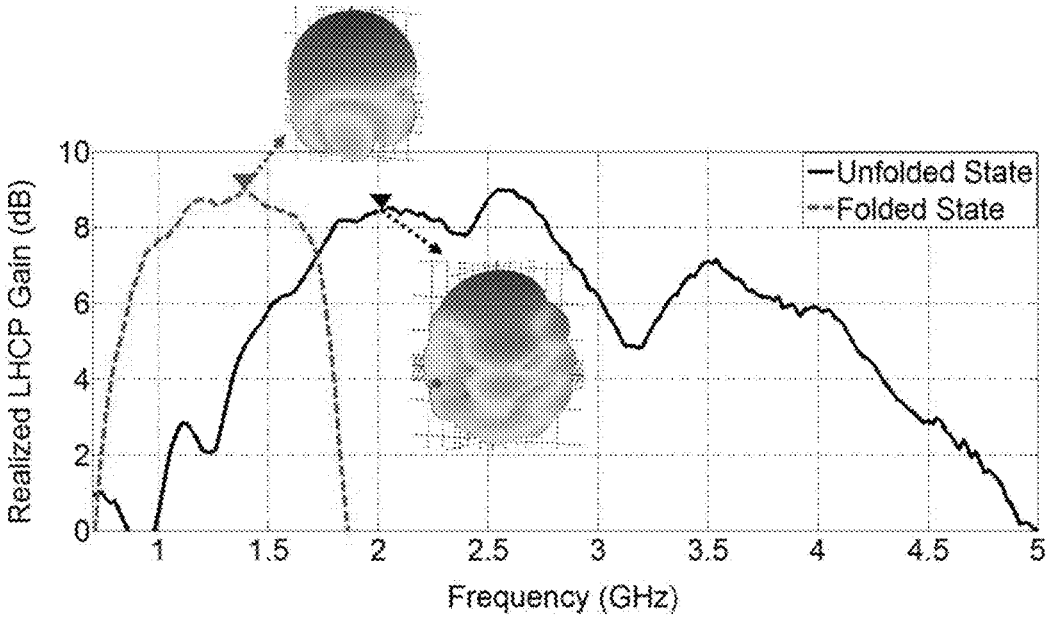

FIG. 8(*a*) shows a measured return loss of a foldable antenna according to an embodiment of the subject invention. FIG. 8(*b*) shows a measured axial ratio of the foldable antenna, and FIG. 8(*c*) shows a measured left-hand circular polarization (LHCP) gain of the foldable antenna. Referring to FIGS. 8(*a*)-8(*c*), the foldable antenna has excellent performance as an antenna in both the unfolded state and the folded state while having a foldable characteristic to reduce the volume.

Example 2

Figure 9A:
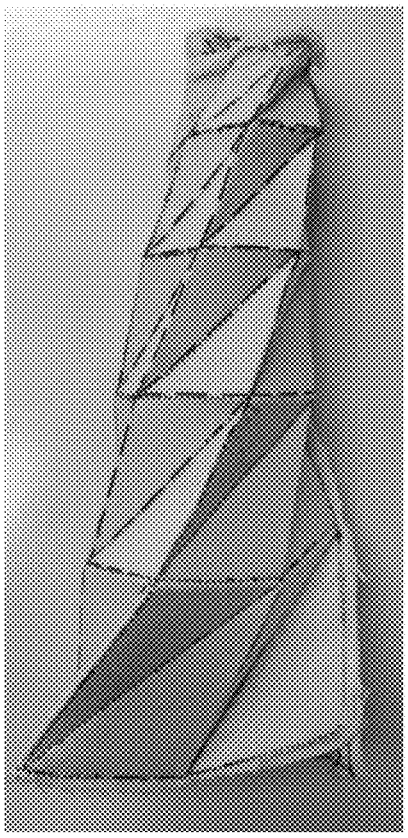
FIG. 9(*a*) shows an unfolded state of a foldable antenna according to an embodiment of the subject invention.
Figure 9B:
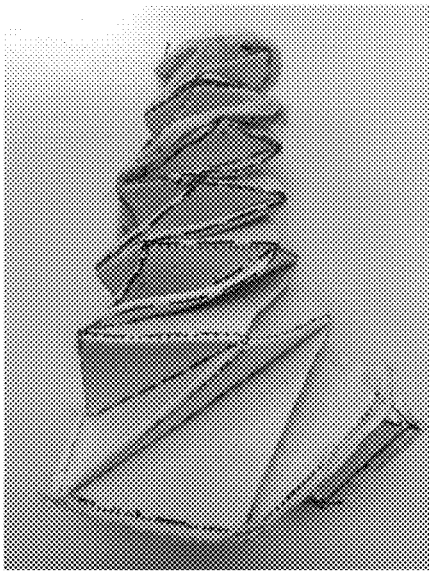

FIGS. 9(*a*) and 9(*b*) show an unfolded state and a folded state of a foldable antenna according to an embodiment of the subject invention. Referring to FIGS. 9(*a*) and 9(*b*), the bottom and top encapsulation layers are made of fabric and a thick origami plastic substrate is sandwiched between two fabric layers. The thickness of the foldable antenna was 29 mil (thousandths of an inch), including a first thickness of 7 mil of the thick origami plastic substrate, a second thickness of 20 mil of the two fabric layers, and a third thickness of 2 mil of the glue. The final origami cone was formed by stitching the origami 2D structure into a 3D structure, thereby resulting in the popping fabric origami cone shown in FIGS. 9(*a*) and 9(*b*).

Example 3—Applications

Figure 10A:
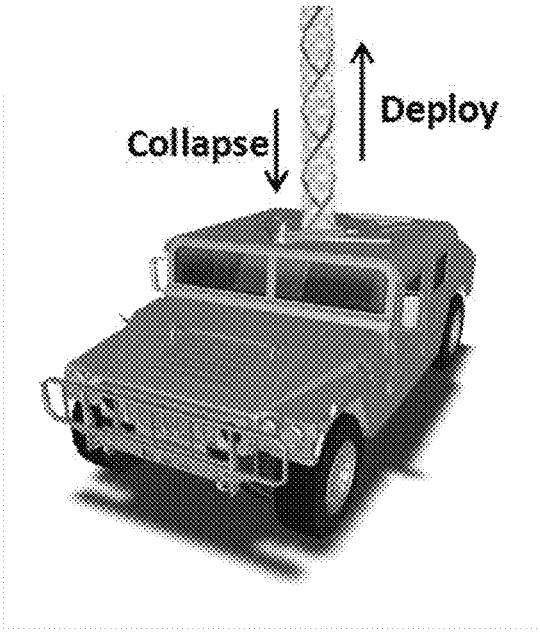
FIG. 10(*a*) shows an application of a foldable antenna according to an embodiment of the subject invention to a moving vehicle.
Figure 10B:
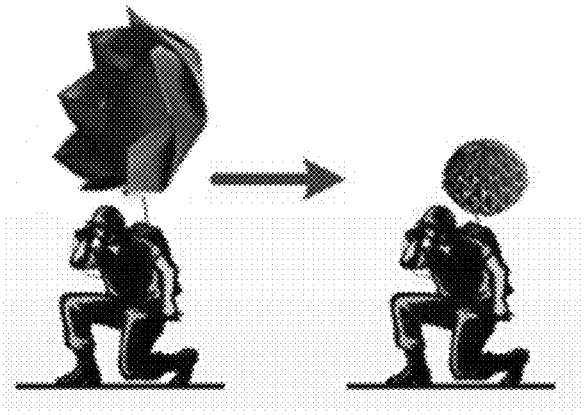
Figure 10C:
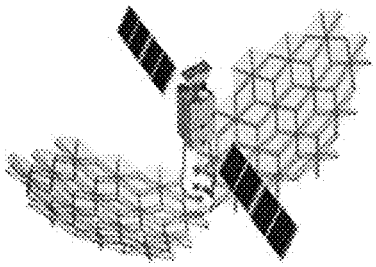

FIGS. 10(*a*)-10(*c*) show a plurality of applications of foldable antennas according to embodiments of the subject invention. For example, a foldable antenna can be applied to a moving vehicle, an individual apparatus, or a satellite. In the moving vehicle, the foldable antenna can provide multifunctional communications and can be deployable or collapsible. In the individual apparatus, the foldable antenna can be used as a tactical antenna. In the satellite, the foldable antenna can be used as a spaceborne and airborne antenna.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A foldable antenna, comprising:

a bottom encapsulation layer;

a plurality of origami substrates disposed on the bottom encapsulation layer;

a top encapsulation layer disposed on the plurality of origami substrates; and a conductive trace comprising conductive antenna elements disposed on the top encapsulation layer, each origami substrate of the plurality of origami substrates being spaced apart from each other origami substrate of the plurality of origami substrates, the bottom encapsulation layer being disposed on, and in direct physical contact with, each origami substrate of the plurality of origami substrates, and the top encapsulation layer being disposed on, and in direct physical contact with, each origami substrate of the plurality of origami substrates, and the conductive trace being disposed on at least two origami substrates of the plurality of origami substrates that are spaced apart from each other.

2. The foldable antenna according to claim 1, each origami substrate of the plurality of origami substrates comprising at least one of foam, plastic, carton, FR4, laminate, and wood.

3. The foldable antenna according to claim 1, at least one of the bottom encapsulation layer and the top encapsulation layer comprising a fabric.

4. The foldable antenna according to claim 1, the conductive trace comprising at least one of conductive cloth tape, conductive thread, conductive tape, conductive wire, and microfluidic channel with liquid metal.

5. The foldable antenna according to claim 4, further comprising a fixing material on the conductive trace, the fixing material comprising at least one of glue, sewing, stitching, adhesive, epoxy, and soldering.

6. The foldable antenna according to claim 1, the top encapsulation layer comprising a plurality of folding patterns corresponding to the plurality of origami substrates, respectively.

7. The foldable antenna according to claim 1, a first side peripheral area of the bottom encapsulation layer or the top encapsulation layer being attached to a second side peripheral area of the bottom encapsulation layer or the top encapsulation layer such that the foldable antenna has a structure of at least one of a cylinder and a cone.

8. The foldable antenna according to claim 7, the bottom encapsulation layer and the top encapsulation layer being attached to each other by at least one of glue, sewing, stitching, adhesive, and epoxy.

9. The foldable antenna according to claim 7, the plurality of origami substrates being arranged in an array.

10. The foldable antenna according to claim 7, further comprising a conductive ground plane supporting the cylinder structure or the cone structure.

11. The foldable antenna according to claim 7, further comprising a scaffolding disposed on the top encapsulation layer.

12. The foldable antenna according to claim 7, the plurality of origami substrates being arranged such that spaces are present between adjacent origami substrates of the plurality of origami substrates, such that the foldable antenna is configured to be folded.

13. A method of manufacturing a foldable antenna, the method comprising:

preparing a bottom encapsulation layer;

disposing a plurality of origami substrates on the bottom encapsulation layer;

preparing a top encapsulation layer;

disposing a conductive trace comprising conductive antenna elements on the top encapsulation layer; and attaching the top encapsulation layer to the bottom encapsulation layer such that the plurality of origami substrates are encapsulated by the bottom encapsulation layer and the top encapsulation layer, each origami substrate of the plurality of origami substrates being spaced apart from each other origami substrate of the plurality of origami substrates, the bottom encapsulation layer being disposed on, and in direct physical contact with, each origami substrate of the plurality of origami substrates, the top encapsulation layer being disposed on, and in direct physical contact with, each origami substrate of the plurality of origami substrates, and the conductive trace being disposed on at least two origami substrates of the plurality of origami substrates that are spaced apart from each other.

14. The method according to claim 13, further comprising forming a plurality of folding patterns on the top encapsulation layer by at least one of adhering, drawing, and stamping, each of the plurality of folding patterns of the top encapsulation layer corresponding to each of the plurality of origami substrates, respectively.

15. The method according to claim 14, further comprising attaching a first side peripheral area of the bottom encapsulation layer or the top encapsulation layer to a second side peripheral area of the bottom encapsulation layer or the top encapsulation layer such that the foldable antenna has a structure of at least one of a cylinder and a cone.

16. The method according to claim 15, at least one of the bottom encapsulation layer and the top encapsulation layer comprising a fabric.

17. The method according to claim 16, each origami substrate of the plurality of origami substrates comprising at least one of foam, plastic, carton, FR4, laminate, and wood.

18. The method according to claim 17, the conductive trace comprising at least one of conductive cloth tape, conductive thread, conductive tape, conductive wire, and microfluidic channel with liquid metal.

19. The method according to claim 18, attaching the top encapsulation layer to the bottom encapsulation layer comprising sewing the top encapsulation layer to the bottom encapsulation layer along the plurality of folding patterns.

20. A foldable antenna, comprising:

a bottom encapsulation layer;

a plurality of origami substrates disposed on the bottom encapsulation layer;

a top encapsulation layer disposed on the plurality of origami substrates and the bottom encapsulation layer; and a conductive trace comprising conductive antenna elements disposed on the top encapsulation layer, each origami substrate of the plurality of origami substrates being spaced apart from each other origami substrate of the plurality of origami substrates, each origami substrate of the plurality of origami substrates being encapsulated by the bottom and top encapsulation layers, the top encapsulation layer comprising a plurality of folding patterns corresponding to the plurality of origami substrates, respectively, each of the bottom encapsulation layer and the top encapsulation layer comprising a fabric, each origami substrate of the plurality of origami substrates comprising at least one of foam, plastic, carton, FR4, laminate, and wood, the conductive trace comprising at least one of conductive cloth tape, conductive thread, conductive tape, conductive wire, and microfluidic channel with liquid metal, the bottom encapsulation layer being disposed on, and in direct physical contact with, each origami substrate of the plurality of origami substrates, the top encapsulation layer being disposed on, and in direct physical contact with, each origami substrate of the plurality of origami substrates, and the conductive trace being disposed on at least two origami substrates of the plurality of origami substrates that are spaced apart from each other.

* * * * *